US008080723B2

(12) United States Patent
Yagi

(10) Patent No.: US 8,080,723 B2
(45) Date of Patent: Dec. 20, 2011

(54) RHYTHM MATCHING PARALLEL PROCESSING APPARATUS IN MUSIC SYNCHRONIZATION SYSTEM OF MOTION CAPTURE DATA AND COMPUTER PROGRAM THEREOF

(75) Inventor: Ryoichi Yagi, Fujimino (JP)

(73) Assignee: KDDI Corporation, Tokyo (JP)

( * ) Notice: Subject to any disclaimer, the term of this patent is extended or adjusted under 35 U.S.C. 154(b) by 177 days.

(21) Appl. No.: 12/687,383

(22) Filed: Jan. 14, 2010

(65) Prior Publication Data

US 2010/0175538 A1 Jul. 15, 2010

(30) Foreign Application Priority Data

Jan. 15, 2009 (JP) ..... 2009-006773

(51) Int. Cl.
*G10H 1/40* (2006.01)
*G10H 7/00* (2006.01)

(52) U.S. Cl. ..... 84/611; 345/473

(58) Field of Classification Search ..... 84/611; 345/473–475

See application file for complete search history.

(56) References Cited

U.S. PATENT DOCUMENTS 6,646,644 B1 * 11/2003 Suzuki et al. ..... 345/474
7,402,743 B2 * 7/2008 Clark et al. ..... 84/615
7,674,967 B2 * 3/2010 Makino ..... 84/612
2007/0052711 A1 * 3/2007 Gordon et al. ..... 345/473
2008/0060499 A1 * 3/2008 Sitrick ..... 84/477 R
2010/0118033 A1 * 5/2010 Faria ..... 345/473

OTHER PUBLICATIONS

"Automatic Synthesis of Dance Performance Using Motion and Musical Features" (the transactions of the Institute of Electrons, Information and Communication Engineers (IEICE), D: Information and Systems, vol. 90, No. 8, (Aug. 2007), pp. 2242-2252.
"Analysis of Dance Motion by Correlations between Motion Data" (The transactions of the Institute of Electrons, Information and Communication Engineers (IEICE), D-II: Information and Systems, vol. J88-D-II, No. 8 (Aug. 11, 2005), pp. 1652-1661.

* cited by examiner

*Primary Examiner* — Jeffrey Donels
(74) *Attorney, Agent, or Firm* — Westman, Champlin & Kelly, P.A.

(57) ABSTRACT

Computation time of correlation comparison between rhythm features obtained from motion capture (MoCap) data and rhythm features obtained from music data is shortened. A rhythm matching parallel processing apparatus includes a feature holding unit which holds beat information of a music segment of input music data and MoCap data having motion beat features of high correlation with beat features of the input music data, a correlative value computation parallel execution procedure registering unit which registers a correlation value computation parallel execution procedure, and a correlation value parallel computing unit which computes in parallel correlation values between the motion beat features of the MoCap data and the beat information of the music segment held in the feature holding unit. The correlation value parallel computing unit obtains in parallel a highest correlation value between the beat features of the music segment and the motion beat features of the MoCap data.

4 Claims, 3 Drawing Sheets

RHYTHM MATCHING PARALLEL PROCESSING APPARATUS IN MUSIC SYNCHRONIZATION SYSTEM OF MOTION CAPTURE DATA AND COMPUTER PROGRAM THEREOF

The present application claims priority of Japanese patent application Serial No. 2009-006773, filed Jan. 15, 2009, the content of which is hereby incorporated by reference in its entirety.

BACKGROUND OF THE INVENTION

1. Field of the Invention

The present invention relates to a rhythm matching parallel processing apparatus and its computer program capable of, in a synchronization system of rhythm features obtained from music data and rhythm features obtained from motion capture data (hereinafter referred to as "MoCap"), parallelizing rhythm matching processing for automatic extraction of correlation values of the features to shorten computation time in correlation comparison of the features.

2. Description of the Related Art

The above-mentioned music synchronization system of the MoCap data aims to generate, for example, much or various dance performance matching a music from an input music signal. Typically, as illustrated in FIG. 4, there are processing (step S1) of matching between beat features of MoCap data and each segment of the music and extracting a plurality of motion segment candidates from the MoCap data for each segment of the music, processing (step S2) of checking connectability for the motion segment candidates to determine, out of the motion segment candidates, motion segment candidate pairs that can bring about natural motion when connected, and processing (step S3) of matching with swell features and outputting a pair of motion segment candidates of highest correlation. The step S1 can be called "rhythm matching processing", the step S2 can be called "connectability analyzing processing", and the step S3 can be called "swell matching processing".

Incidentally, the conventional technique relating to the music synchronization system of the MoCap data is disclosed in, for example, the following non-patent documents 1 and 2.

The non-patent document 1 discloses the technique of analyzing music background relating to the expression of dance from an input music signal and generating dance performance in accordance with the analysis result, using dance performance of which expression is one important factor. Extracted from motion data are motion rhythm and swell features, and extracted from music data are rhythm and swell as features divided into segments by music structure analysis. In generation of the dance performance, first, motion segment candidates are all extracted that show high correlation with rhythm components in the music segments obtained by the structure analysis. Then, correlation of a last swell component is obtained to select optimal motion segments and connect them so that the dance performance is generated.

Besides, the non-patent document 2 discloses the technique of analyzing dance performance data obtained by motion capture by use of time-series correlation matrix. The time-series correlation matrix obtained from two motion data pieces is analyzed to inspect relation between the motions. First, attention is given to a feature in the time-series correlation matrix that shows when the two motions are similar to each other, and the motion similarity between the two data pieces is treated quantitatively. This makes it possible to automatically extract a motion area corresponding to a particular part of choreography from the motion data. Next, this similarity analysis is performed on motion data of two performers who perform the same dance thereby to be able to detect a difference between the performers' motions, that is, mistakes or habits.

Non-patent document 1: "Automatic Synthesis of Dance Performance Using Motion and Musical Features" (The transactions of the Institute of Electrons, Information and Communication Engineers (IEICE), D: Information and Systems, Vol. 90, No. 8, (2007/8), pp. 2242 to 2252)

Non-patent document 2: "Analysis of Dance Motion by Correlations between Motion Data" (The transactions of the Institute of Electrons, Information and Communication Engineers (IEICE), D-II: Information and Systems, Vol. J88-D-II, No. 8 (20050811), pp. 1652 to 1661)

In the conventional art, a large amount of MoCap data is required to automatically generate motion data of high correlation with music data. Therefore, in the case of increase in music data size or kinds of MoCap data, the number of pattern matching times and the number of computations of correlation values are extremely increased. Therefore, such generation of the motion data is difficult to realize in a PC, a portable phone or the like of low specifications.

SUMMARY OF THE INVENTION

An object of the present invention is to provide a rhythm matching parallel processing apparatus in a music synchronization system of MoCap data and its computer program capable of shortening a computation time of correlation comparison between rhythm features obtained from music data and rhythm features obtained from MoCap data.

In order to achieve the object, the invention is firstly characterized in that a rhythm matching parallel processing apparatus in a music synchronization system of MoCap (Motion Capture) Data for synchronizing rhythm features obtained from the MoCap data and rhythm features obtained from music data comprises a feature holding unit which holds beat information of a music segment of input music data and MoCap data having motion beat features of high correlation with beat features of the input music data, a correlative value computation parallel execution procedure registering unit which registers a correlation value computation parallel execution procedure, and a correlation value parallel computing unit which computes in parallel correlation values between the motion beat features of the MoCap data and the beat information of the music segment held in the feature holding unit, in accordance with the correlation value computation parallel execution procedure registered in the correlative value computation parallel execution procedure registering unit, wherein the correlation value parallel computing unit obtains in parallel a highest correlation value between the beat features of the music segment and the motion beat features of the MoCap data.

The invention is secondly characterized in that it provides a computer program of rhythm matching processing in a music synchronization system of MoCap (Motion Capture) Data.

According to the present invention, the rhythm matching can be made in parallel thereby to shorten the rhythm matching processing time much as compared with the conventional system. This attributes to real-time operation of the music synchronization system of MoCap data.

In addition, according to the present invention, as the rhythm matching parallel processing can be performed in the CUDA, the CPU can perform other processing during the rhythm matching parallel processing, and the processing efficiency of the CPU can be enhanced.

DETAILED DESCRIPTION OF THE PREFERRED EMBODIMENTS

Figure 4:
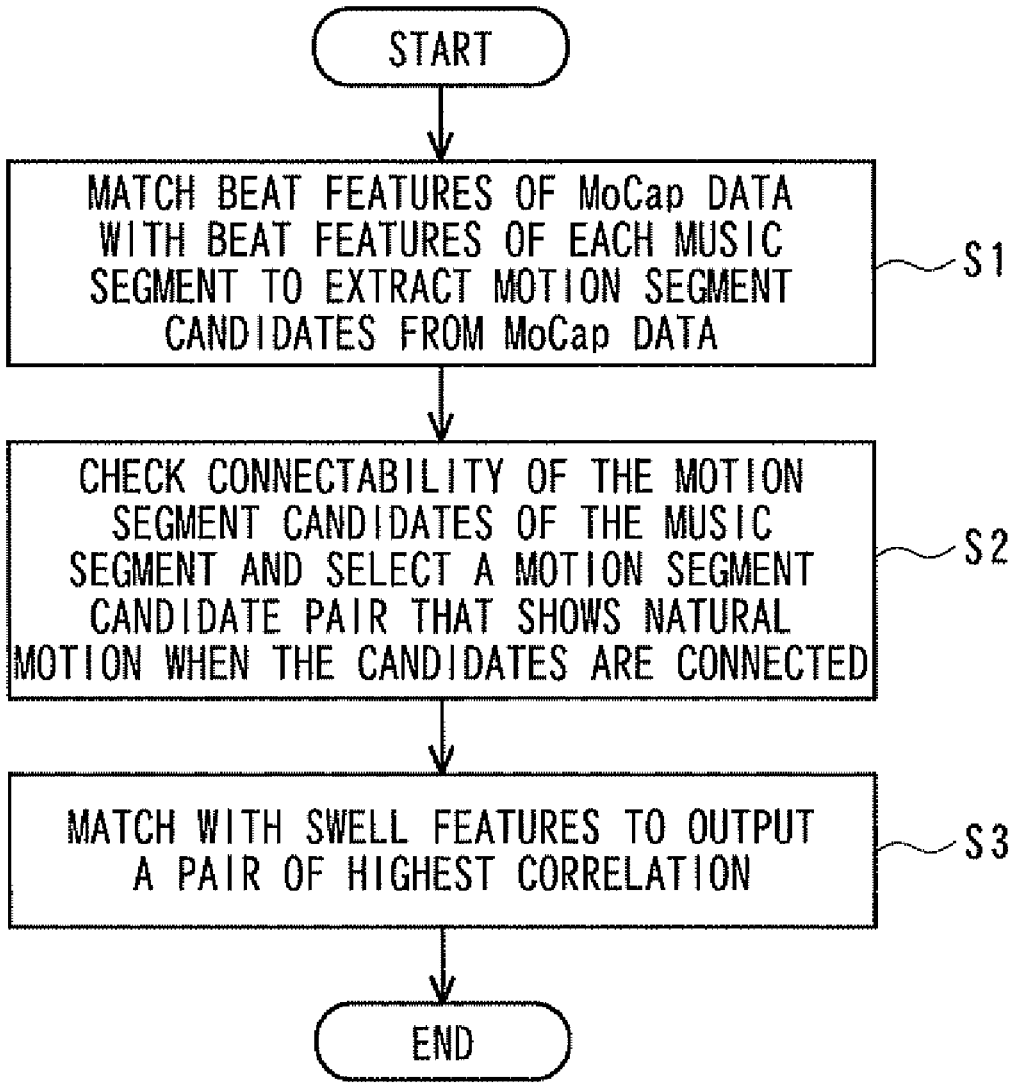
Fig. 4 PRIOR ART
FIG. 4 is a flowchart illustrating processing of the MoCap data music synchronization system.

With reference to the drawings, the present invention will be described in detail below. The present invention relates to an apparatus for performing rhythm matching processing of step S1 of FIG. 4, and an exemplary embodiment of the rhythm matching parallel processing apparatus of the present invention will be described with reference to the block diagram of FIG. 1 below.

As illustrated, the rhythm matching parallel processing apparatus has a music data feature converting unit 1, a feature holding unit 2, a correlative value computation parallel execution procedure registering unit 3, a correlation value parallel computing unit 4, a correlation value parallel computation control unit 5, and a correlation value computation result obtaining unit 6.

The music data feature converting unit 1 analyzes input music data and converts it into features. The feature holding unit 2 holds the above-mentioned features of the input music data and MoCap data features. The correlative value computation parallel execution procedure registering unit 3 registers a parallel execution procedure of correlation value computation. The correlation value parallel computing unit 4 performs computation of correlation values between the MoCap data features and the features of input music data held in the feature holding unit 2 in accordance with the correlation value computation parallel execution procedure registered in the correlation value computation parallel execution procedure registering unit 3. The correlation value parallel computation control unit 5 performs processing of outputting correlation value computation results from the correlation value parallel computing unit 4. The correlation value computation result obtaining unit 6 obtains the correlation value computation results from the correlation value parallel computing unit 4.

Figure 2:
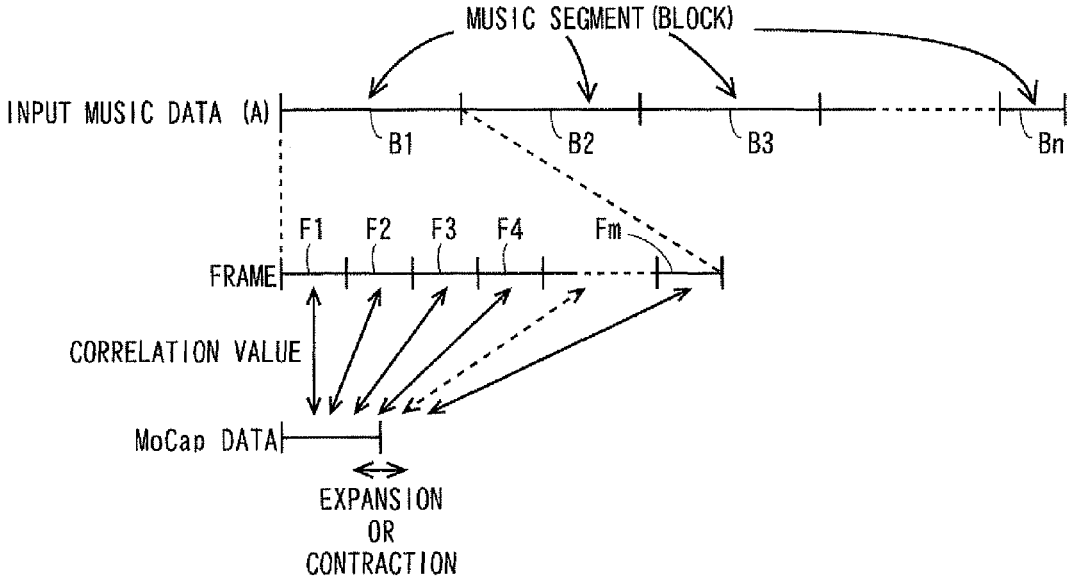
FIG. 2 is an explanatory view of processing, in parallel, of obtaining correlation values between beat features of music segments and motion beat features of MoCap data.

In the present exemplary embodiment, as illustrated in FIG. 2, the input music data (A) is divided into music segments (blocks) B1 to Bn (n is any positive integer) and each of the music segments is further divided into a plurality of frames F1 to Fm (m is any positive integer). This division of music segments can be performed, for example, by the music structure analysis as disclosed in the non-patent document 1. Then, beat information of the music segment is held in the feature holding unit 2. MoCap data (human body skeleton based motion data or the like) having motion beat features of high correlation with the beat features of the input music data (A) is extracted from a MoCap data database. The MoCap data is capable of being extended and contracted by a scale parameter (s) and for example, 10 MoCap data pieces are created by extension or contraction to be held in the feature holding unit 2.

The correlation value parallel computing unit 4 performs in parallel the processing of obtaining correlation values between the MoCap data and music information of the frames F1 to Fm input from the feature holding unit 2, that is, the processing of computing the scale parameter (s) for the highest correlation value between the motion beat features of the MoCap data and the beat features of the music segment and its correlation value, in accordance with the correlation value computation parallel execution procedure registered by the correlation value computation parallel execution procedure registering unit 3. The correlation value can be obtained by the following expression (1). This expression (1) is publicly known and also disclosed in the non-patent document 1.

(Expression 1)

$$\underset{s}{\operatorname{argmax}} \sum_{f=0}^{L_{music}} \frac{F_R^{Music}(f;M)\cdot F_R^{Motion}(s\cdot f+f_0)}{F_R^{Music}(f;M)+F_R^{Motion}(s\cdot f+f_0)} \tag{1}$$

$$f_0 \in [0, L_{motion}-L_{music}]$$

In the above-mentioned expression, the $F_R^{music}(f;M)$ is beat information of a segment M, the $F_R^{motion}(f;M)$ is motion beat information, L motion is a length of MoCap data, L music is a length of music segment M, f is a frame, and $F_0$ is a start frame in a beat correlation analyzed part.

Then, threshold processing is performed on correlation values obtained by the above-mentioned expression (1) and a part of the correlation values that satisfies the threshold is separated from the MoCap data to obtain a motion segment. The threshold is obtained in advance by preliminary experiment. The above-mentioned processing is performed on all music segments and then, a motion segment group which comprises of music segments having similar beat features can be obtained.

The correlation value parallel computing unit 4 performs in parallel the above-mentioned processing in accordance with the correlation value computation parallel execution procedure registered in the correlation value computation parallel execution procedure registering unit 3. Computation results by the correlation value parallel computing unit 4 are output from the correlation value parallel computing unit 4 by control of the correlation value parallel computation control unit 5, and the correlation value computation result obtaining unit 6 obtains the correlation value computation results.

For example, when the number of frames F1 to Fm for each one music segment is 500 and the number of frames f1 to Fm for motion segment is 1000, the start frame position $f_a$ in the beat correlation analyzed part has 500 indexes. Further, if 10 MoCap data pieces are formed by expansion or contraction of the MoCap data, computation of the above-mentioned expression is performed 2,500,000 times for one music segment and the computation is considerably increased in number. Besides, as this computation has to be performed in real time, if computation is made by a conventional CPU or GPGPU (for example, serial computation), it takes several ten seconds or several minutes, and practically, there arises a problem of inconvenience.

Figure 3:
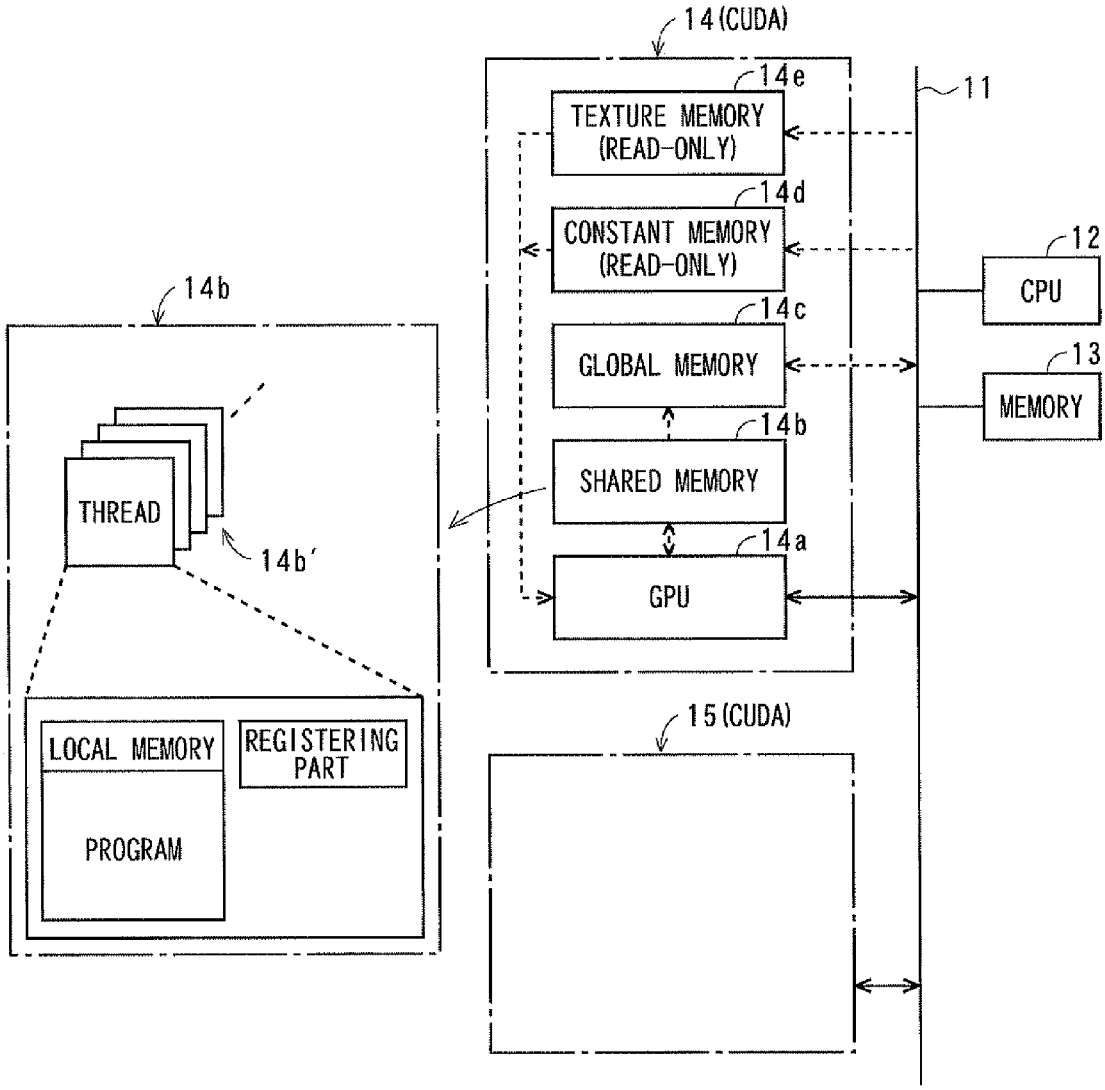
FIG. 3 is a block diagram of an exemplary embodiment of the present invention using a CUDA.

Then, in the present exemplary embodiment, an architecture called CUDA and a program executed in the CUDA are used in this parallel computation. An example of the rhythm matching processing of the present invention executed in the CUDA in accordance with the program is explained with reference to FIG. 3.

A bus 11 is connected to a CPU 12, a memory 13 such as a RAM and a ROM and the CUDA 14. The CUDA 14 has, as illustrated in the figure, mainly, a GPU (Graphic Processing Unit) 14*a*, a shared memory 14*b*, a global memory 14*c*, a constant memory 14*d* and a texture memory 14*e*. The CPU 12 cannot access the shared memory 14*b* directly, and it accesses the shared memory 14*b* via the GPU 14*a*. The global memory 14*c* can receive transferred data of computation results obtained by the computation of the GPU 14*a* and the shared memory 14*b* and temporally stored in the shared memory 14*b*, and the transferred data can be read by the CPU 12. The constant memory 14*d* and the texture memory 14*e* are read-only memories and the GPU 14*a* only can read the data written in the memory 14*d* or 14*e* by the CPU 12. The shared memory 14*b* has, as illustrated in the figure, a plurality of threads 14*b*', and each of them has a local memory having computing programs and a registering part.

Figure 1:
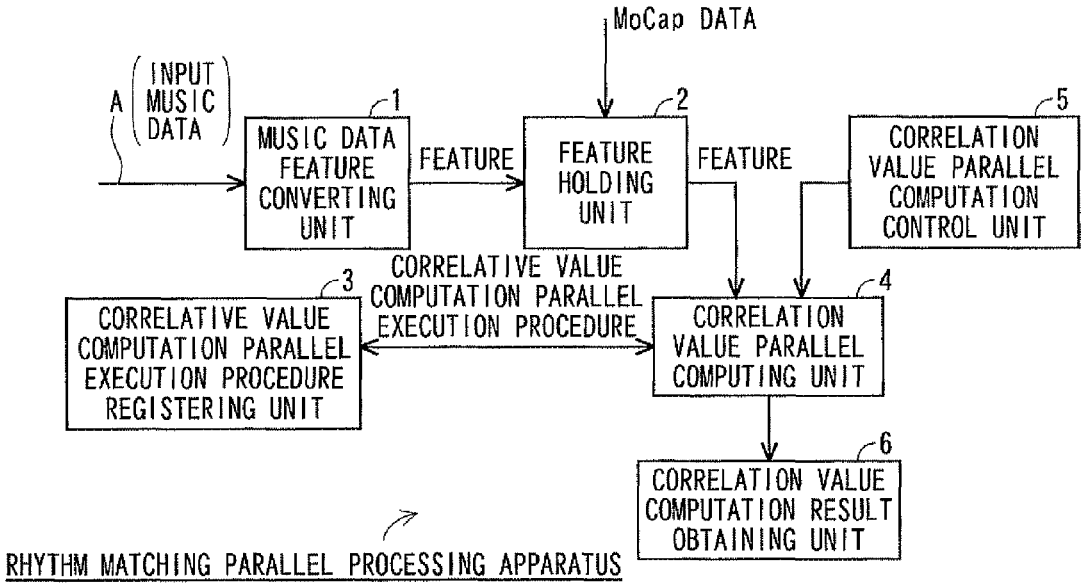
FIG. 1 is a block diagram illustrating an outline structure of a rhythm matching parallel processing apparatus according to the present invention.

The music data feature converting unit 1 in FIG. 1 corresponds to the CPU 12, and the beat information of music segments obtained by the CPU 12 and motion beat features extracted from the MoCap data database are stored in the constant memory 14*d* and/or the texture memory 14*e*. The GPU 14*a* reads the beat information of music segments stored in the memory 14*d* and/or 14*e* and the motion beat features of the MoCap data and, in cooperation with the shared memory 14*b*, performs in parallel the processing of obtaining the scale parameter (s) of the highest correlation between the beat features of the music segment and the motion beat features of the MoCap data (computation processing of the above-mentioned expression 1) and its correlation value. Then, threshold processing is performed on obtained correlation values and a part of the correlation values that satisfies the threshold value is separated from the MoCap data to obtain the motion segment.

The motion segment obtained by the parallel processing is temporarily held in each thread 14*b*' of the shared memory 14*b* and transferred from the thread 14*b*' to the global memory 14*c*. As a result, the shared memory 14*b* is in an unused state or state where the data can be deleted so that the rhythm matching parallel processing can be performed for next music segment. The data transferred to the global memory 14*c* is read by the CPU 12 to be provided for the next processing. For example, it is provided for the connectability of step S2 of FIG. 4.

If another CUDA 15 is connected to the bus 11, the CUDA 15 can be used to perform other rhythm matching parallel processing simultaneously.

Up to this point, the present invention has been described by way of the preferred exemplary embodiment; however, the present invention is not limited to this embodiment. Various modifications can be made in the present invention without departing from the scope of the present invention.

What is claimed is:

1. A rhythm matching parallel processing apparatus in a music synchronization system of MoCap (Motion Capture) Data for synchronizing rhythm features obtained from the MoCap data and rhythm features obtained from music data, comprising:

a feature holding unit which holds beat information of a music segment of input music data and MoCap data having motion beat features of high correlation with beat features of the input music data;

a correlative value computation parallel execution procedure registering unit which registers a correlation value computation parallel execution procedure; and a correlation value parallel computing unit which computes in parallel correlation values between the motion beat features of the MoCap data and the beat information of the music segment held in the feature holding unit, in accordance with the correlation value computation parallel execution procedure registered in the correlative value computation parallel execution procedure registering unit, wherein the correlation value parallel computing unit obtains in parallel a highest correlation value between the beat features of the music segment and the motion beat features of the MoCap data.

2. The rhythm matching parallel processing apparatus in the music synchronization system of MoCap data according to claim 1, wherein the beat information of the music segment is beat information of each of frames into which the music segment is divided.

3. The rhythm matching parallel processing apparatus in the music synchronization system of MoCap data according to claim 1, wherein the correlative value computation parallel execution procedure registering unit and the correlation value parallel computing unit are realized in a CUDA architecture.

4. A computer program of rhythm matching processing in a music synchronization system of MoCap (Motion Capture) Data for making a computer function as:

means for obtaining beat information of each of frames into which a music segment of input music data is divided;

means for extracting MoCap data having motion beat features of high correlation with beat features of the input music data from a MoCap data database;

correlation value parallel computing means for computing in parallel correlation values between the motion beat features of the MoCap data extracted and the beat information of the frame, in accordance with a correlation value computation parallel execution procedure registered in advance; and means for performing threshold processing on the correlation values obtained by the correlation value parallel computing means and separating a part of the correlation values that satisfies a threshold from the MoCap data to output as a motion segment.

* * * * *